US006502564B1

(12) United States Patent
Gagnon et al.

(10) Patent No.: US 6,502,564 B1
(45) Date of Patent: Jan. 7, 2003

(54) EXHAUST GAS RECIRCULATION SYSTEM MODULE

(75) Inventors: Frederic Gagnon; Peter Hueniken, both of Chatham (CA)

(73) Assignee: Siemens Canada Limited (CA)

( * ) Notice: Subject to any disclaimer, the term of this patent is extended or adjusted under 35 U.S.C. 154(b) by 0 days.

(21) Appl. No.: 09/640,046

(22) Filed: Aug. 17, 2000

Related U.S. Application Data

(60) Provisional application No. 60/149,330, filed on Aug. 17, 1999.

(51) Int. Cl.[7] ..... F02M 25/07
(52) U.S. Cl. ..... 123/568.27; 123/568.29
(58) Field of Search ..... 123/568.11, 568.26–568.29

(56) References Cited

U.S. PATENT DOCUMENTS 4,566,423 A 1/1986 Kenny et al. ..... 123/571
4,690,120 A 9/1987 Egle ..... 123/571
4,834,054 A 5/1989 Hashimoto et al. ..... 123/571
5,448,981 A 9/1995 Cook et al. ..... 123/520
5,613,479 A * 3/1997 Gates et al. ..... 123/568.27
5,967,172 A 10/1999 Cook ..... 137/82
6,116,224 A * 9/2000 Cook et al. ..... 123/568.27

* cited by examiner

*Primary Examiner*—Gene Mancene
*Assistant Examiner*—Arnold Castro

(57) ABSTRACT

An exhaust gas recirculation (EGR) system module is provided that integrally includes an electric vacuum regulator (EVR) valve and a differential pressure (DP) sensor. The DP sensor measures a differential exhaust pressure at locations upstream and downstream of an orifice in a gasket sealing the EGR system module to an intake manifold. The upstream measurement location is aligned with and particularly spaced from the orifice.

20 Claims, 3 Drawing Sheets

Figure 4
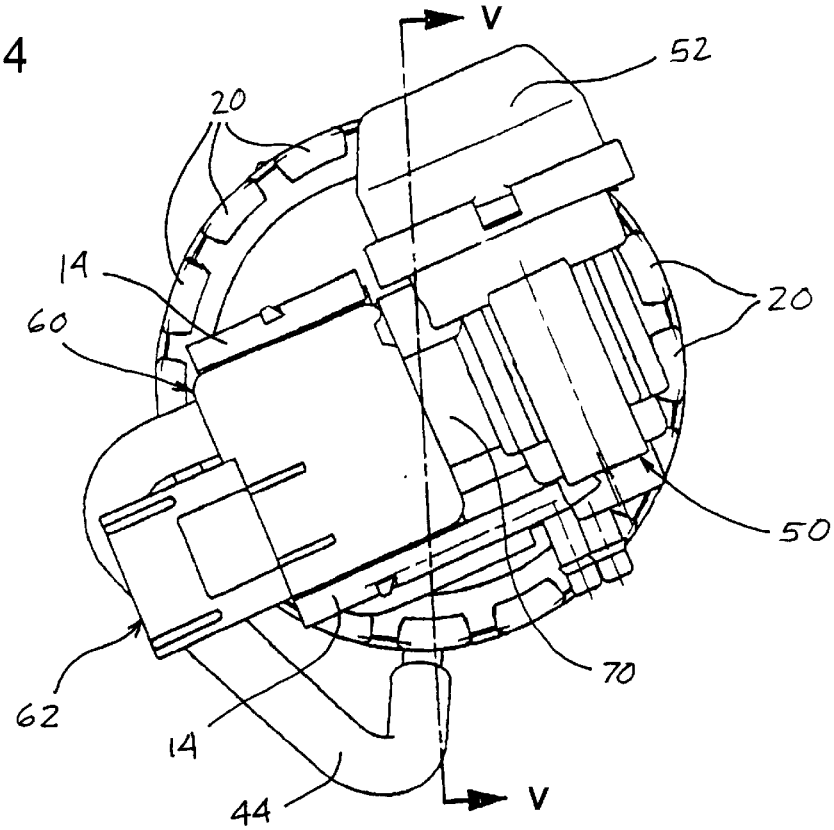
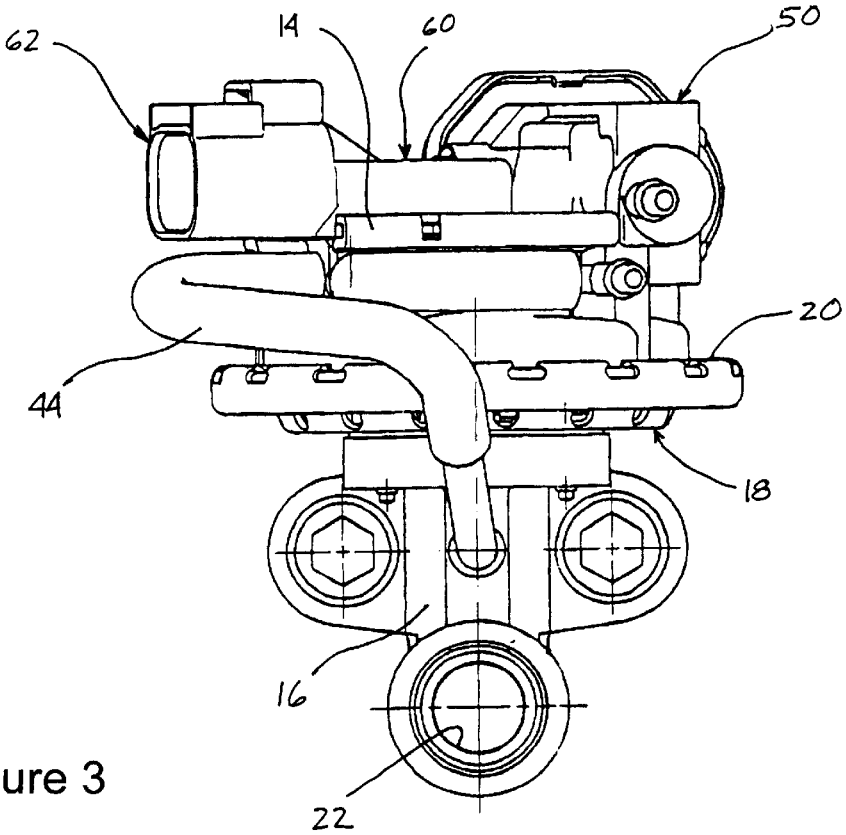
Figure 3

EXHAUST GAS RECIRCULATION SYSTEM MODULE

CROSS-REFERENCE TO CO-PENDING APPLICATIONS

This application claims the benefit of the earlier filing date of U.S. Provisional Application No. 60/149,330, filed Aug. 17, 1999, the disclosure of which is incorporated by reference herein in its entirety.

FIELD OF THE INVENTION

This invention relates to an automotive exhaust gas recirculation (EGR) system module, and more particularly, to an EGR system having an electric vacuum regulator (EVR) valve and a differential pressure (DP) sensor combined in a single assembly.

BACKGROUND OF THE INVENTION

Various systems have been developed to reduce the emission of undesirable combustion products, such as nitrogen oxides (NOX), from internal combustion engines. One such system is the EGR system. In EGR systems, a portion of the engine exhaust is recirculated into the intake manifold where it mixes with incoming air. The mixture of the exhaust gases with the air-fuel mixture in the engine cylinders provides lower peak temperatures during combustion, resulting in a reduction in the quantity of NOX produced.

Known EGR systems utilize an EGR tube to divert a portion of the exhaust gases from an engine back into the intake manifold of the engine. A vacuum-operated EGR valve is arranged between the EGR tube and the intake manifold to regulate the flow of exhaust gases into the manifold. The intake manifold provides the vacuum source for operating the EGR valve. A first hose connects the manifold to an EVR valve, and a second hose connects the EVR valve to the EGR valve. The EVR valve receives a control signal from the engine control unit (ECU) and regulates the amount of vacuum provided to the EGR valve, which in turn limits the flow of exhaust gases into the intake manifold.

The ECU computes the EVR control signal based on a measurement of the differential pressure of exhaust gases between two points in the EGR tube. The differential pressure reflects the amount of flow of exhaust gases in the system. The pressure measurement is obtained using a DP sensor. The DP sensor operates by measuring the pressure of exhaust gases at locations on either side of a flow restriction, or orifice, in the EGR tube. The DP sensor continuously determines a delta pressure value for the exhaust gases and provides corresponding electronic data to the ECU. The ECU then uses this data to compute the EVR control signal.

There are several drawbacks associated with known EGR systems. The individual sensors and actuators used in these systems each require mounting brackets, electrical connections, and input and outlet hoses. Further, the DP orifice and hose connections on the EGR tube require additional manufacturing steps during production of the tube. Finally, the components in proximity to the exhaust system must be made from special heat-resistant materials to allow them to withstand the heat produced by the exhaust gases. The additional, specialized parts and the added manufacturing and assembly steps result in high production costs.

SUMMARY OF THE INVENTION

The present invention provides a system module integrating an EGR system, an EVR valve, and a DP sensor into a single unit. This system module can be mounted directly on an intake manifold of an internal combustion engine. Moreover, a single, common port on the intake manifold can provide a vacuum input connection to the EVR and the DP sensor of the system module.

The DP sensor measures exhaust pressure differential at locations upstream and downstream of an orifice that can be formed in a gasket sealing the EGR valve to the intake manifold. The upstream measurement location is in an EGR body, and the downstream location is in the intake manifold. Both orifices are located downstream of the EGR valve.

The present invention provides a system module for recirculating exhaust gases from an internal combustion engine to an intake manifold of the internal combustion engine. The system module comprises a body including a passageway extending between an inlet and an outlet, the passageway communicating a flow of the exhaust gases; an orifice constricting the flow of the exhaust gases proximate the outlet; a valve located in the passageway between the inlet and outlet, the valve regulating the flow of the exhaust gases; and a port extending through the body and in fluid communication with the passageway, the port being aligned with the orifice along a common axis.

The present invention also provides an exhaust gas recirculation module. The module comprises a valve assembly including a body having a passageway and including a pintle controlling a flow of exhaust gases through the passageway, the exhaust gases having a pressure; a pressure sensor coupled to the valve assembly; and a pressure communication pathway providing fluid communication between the passageway and the pressure sensor, the pathway communicating the pressure of the exhaust gases to the pressure sensor.

The present invention further provides a method of determining exhaust gas pressure. The exhaust gas is recirculated from an internal combustion engine to an intake manifold of the internal combustion engine. The method comprises providing a body including a passageway extending between an inlet and an outlet, the passageway communicating a flow of the exhaust gases; providing an orifice constricting the flow of the exhaust gases proximate the outlet; integrally mounting an exhaust gas pressure sensor on the body; and aligning a port along a common axis with the orifice, the port extending through the body and providing fluid communication between the passageway and the exhaust gas pressure sensor.

BRIEF DESCRIPTION OF THE DRAWINGS

The accompanying drawings, which are incorporated herein and constitute part of this specification, illustrate presently preferred embodiments of the invention and, together with the general description given above and the detailed description given below, serve to explain features of the invention.

FIG. 3 is a right-side view of the EGR system module shown in FIG. 1.

FIG. 4 is a top view of the EGR system module shown in FIG. 1.

DETAILED DESCRIPTION OF THE PREFERRED EMBODIMENTS

Figure 1:
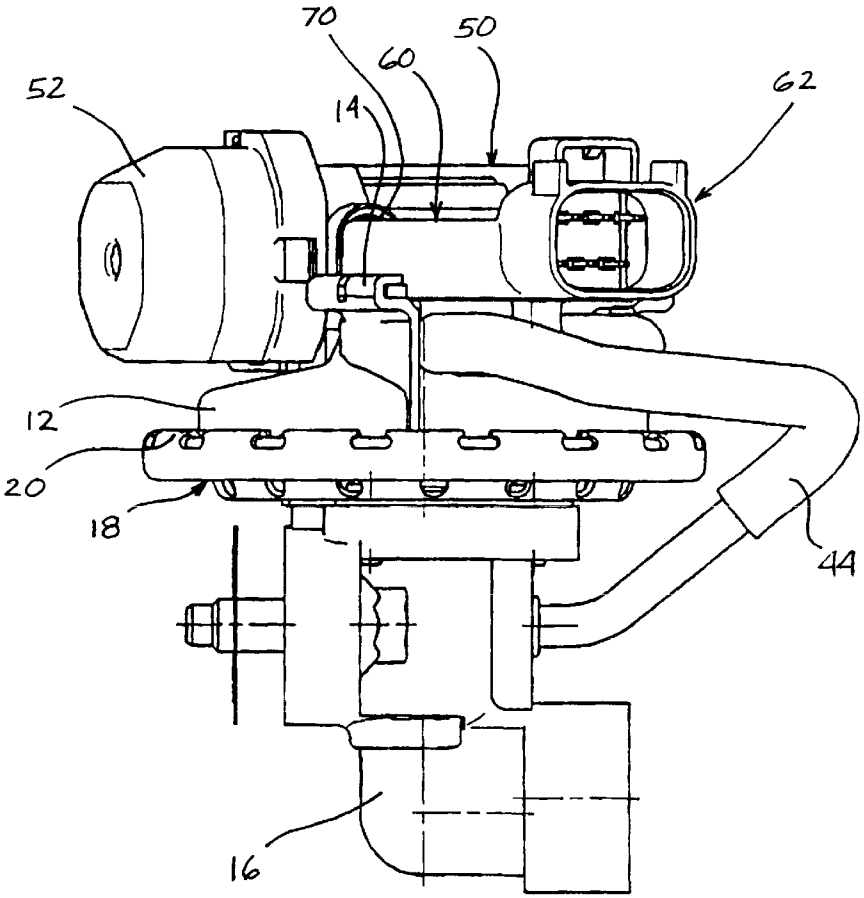
FIG. 1 is a front view of an EGR system module according to the claimed invention.
Figure 2:
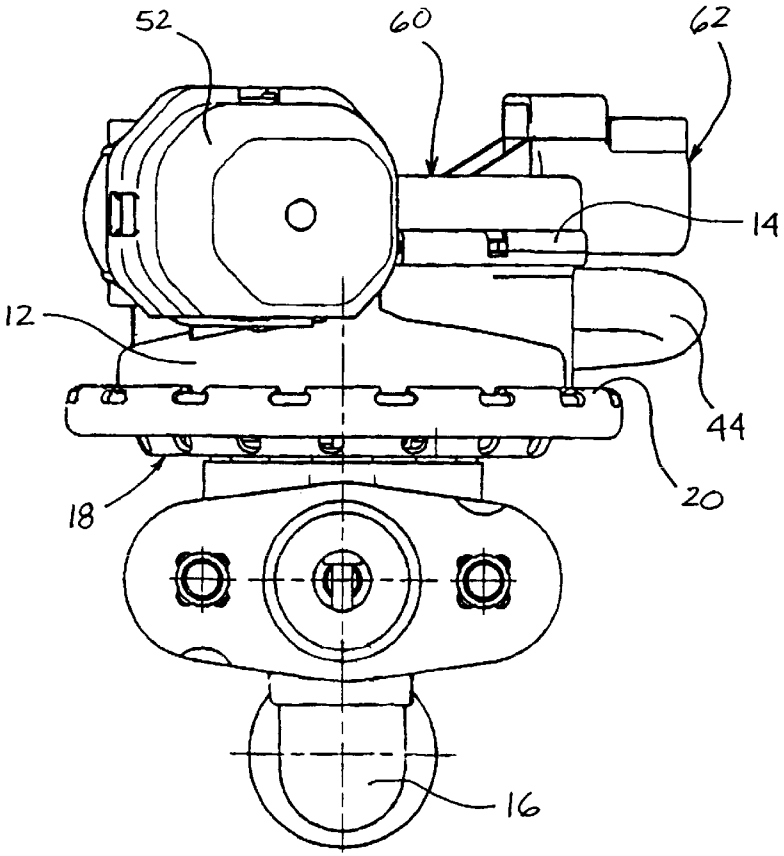
FIG. 2 is a left-side view of the EGR system module shown in FIG. 1.
Figure 5:
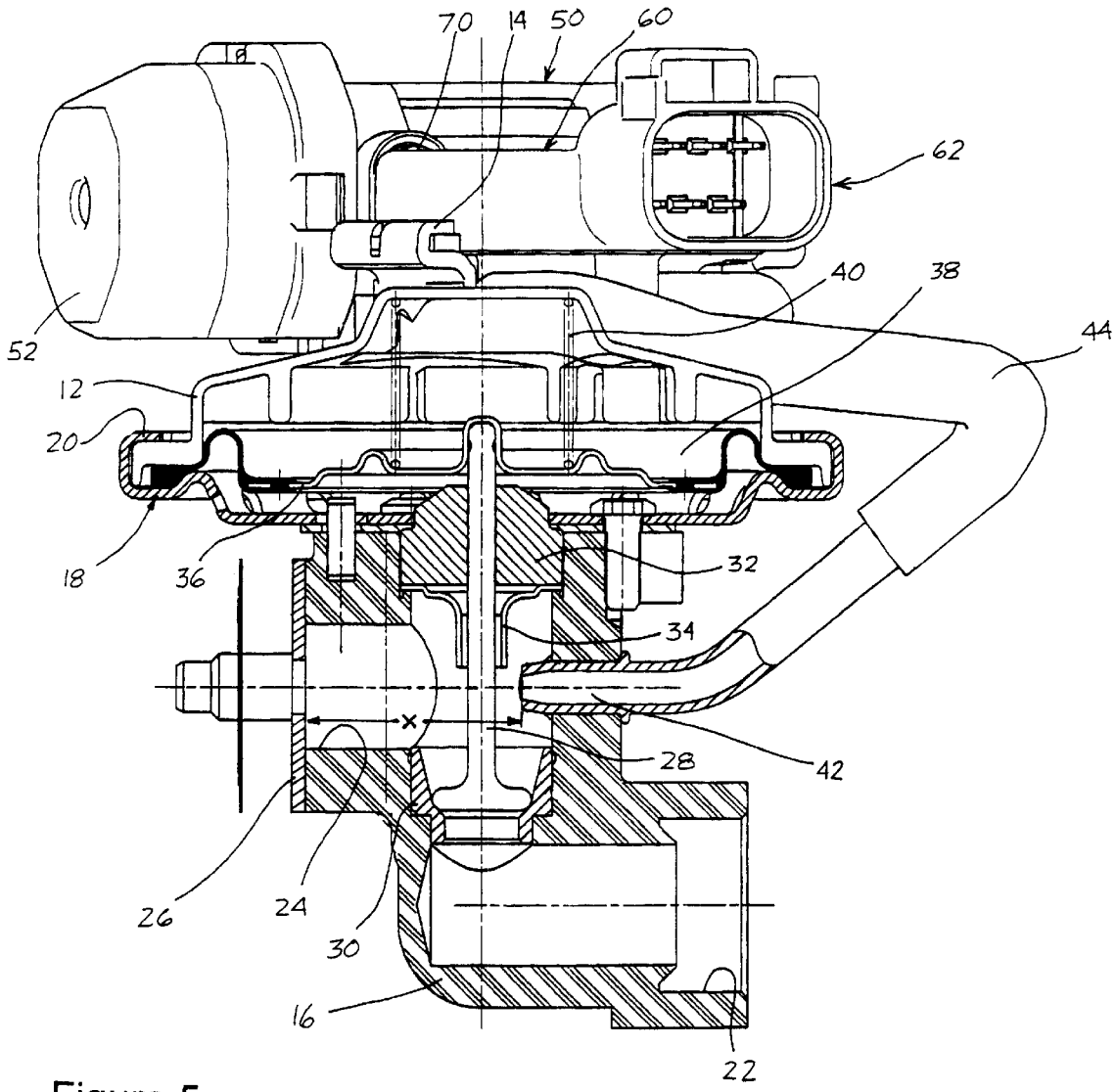
FIG. 5 is a cross-section view taken along line V—V in FIG. 4.

FIGS. 1–5 illustrate an EGR system module 10 including an upper body 12 integrally connected with an EVR 50 and a DP sensor 60. The EVR 50 includes a cap 52 with a filter inside the cap 52. The EVR 50 and the DP sensor 60 are in fluid communication via a connection 70. The DP sensor 60 is integrally connected with the upper body 12 via mounting rails 14. A multiple pin connector 62 for electrically interconnecting the EGR system module 10 to an ECU (not shown) can be integrally formed with the DP sensor 60.

Examples of EVR valves that may be used are disclosed in commonly assigned U.S. Pat. No. 5,448,981 to Cook et al. and U.S. Pat. No. 5,967,172 to Cook, which are incorporated herein in their entirety by reference.

The EGR system module 10 includes an EGR body 16 that is integrally connected with the upper body 12 via a cap 18. Tabs 20 on the cap 18 can be deformed to clinch the upper body 12. This arrangement allows the upper body 12 to be rotated to a desired angular orientation with respect to the EGR body 16 during assembly. Thus, the EVR 50 and the DP sensor 60 can be oriented as desired in the finished EGR system module.

The EGR body 16 includes an exhaust gas inlet 22, which is adapted to be connected to an exhaust gas supply (not shown), and an exhaust gas outlet 24, which is adapted to be connected to an intake manifold (not shown). A gasket orifice 26 can be located at the exhaust gas outlet 24 to develop a pressure differential on either side of the gasket orifice 26 and to provide a seal for the connection to the EGR body 16. Specifically, the gasket orifice 26 can be formed as a thin gasket that seals the EGR body 16 onto the intake manifold (not shown). The gasket orifice 26 can be made of stainless steel, which provides dimensional stability at high temperatures. Of course, other materials exhibiting similar properties can be used.

The relative spacing between a pintle 28 and a seat 30 regulates the flow of exhaust gas from the inlet 22 to the outlet 24. The pintle 28 is slidably mounted with respect to the EGR body 16 by a bearing 32. A stem shield 34 can protect the bearing 32 from contact with hot exhaust gases. The pintle 28 is connected to a diaphragm 36 that is clamped around its periphery between the upper body 18 and the cap 18. The diaphragm 36 serves as an actuator wall that is movable in response to vacuum in a chamber 38. As is known, the intake manifold (not shown) provides the source of vacuum for the chamber 38. A spring 40 normally biases the diaphragm 36 and the pintle 28 to a closed position with respect to the seat 30.

The DP sensor 60 measures the pressures on either side of the gasket orifice 26. An internal passage 42 that extends through the EGR body 16, and a hose 44, provide the DP sensor 60 with the pressure signal from the upstream side, i.e., exhaust manifold side, of the gasket orifice 26. The internal passage 42 is opposite the outlet 24 and aligned with the gasket orifice 26. This arrangement ensures greater accuracy making EGR flow readings and simplifies the manufacturing process since the bores for the outlet 24 and the internal passage 42 can be machined in a single operation. The optimal range for the spacing "X" (see FIG. 5) between the gasket orifice 26 and the internal passage 42 has been found to be approximately 15 to 25 millimeters.

The DP sensor 60 can be connected directly to the intake manifold (not shown) on the downstream side of the gasket orifice 26. The DP sensor 60 and the EVR valve 50 can both be connected to the intake manifold (not shown) via a common port that provides a source of vacuum for both the chamber 38 (as regulated by the EVR valve 50) and the DP sensor 60.

The DP sensor 60 continually computes a differential pressure value on either side of the gasket orifice 26 and provides this data to an ECU (not shown), which uses this data to compute an EVR control signal.

While the invention has been disclosed with reference to certain preferred embodiments, numerous modifications, alterations, and changes to the described embodiments are possible without departing from the sphere and scope of the invention, as defined in the appended claims and their equivalents thereof. Accordingly, it is intended that the invention not be limited to the described embodiments, but that it have the full scope defined by the language of the following claims.

What is claimed is:

1. A system module for recirculating exhaust gases from an internal combustion engine to an intake manifold of the internal combustion engine, the system module comprising:

a body including a passageway extending between an inlet and an outlet, the passageway communicating a flow of the exhaust gases;

an orifice constricting the flow of the exhaust gases proximate the outlet;

a valve located in the passageway between the inlet and outlet, the valve regulating the flow of the exhaust gases; and a port extending through the body and in fluid communication with the passageway between the inlet and the orifice, the port being aligned with the orifice along a common axis.

2. The system module according to claim 1, further comprising:

a differential pressure sensor in fluid communication with the port on a first side of the orifice, and adapted to be in fluid communication with the intake manifold on a second side of the orifice.

3. The system module according to claim 2, wherein the differential pressure sensor is integrally fixed to the body.

4. The system module according to claim 1, wherein the port includes a mouth spaced from the orifice by a predetermined distance along the axis.

5. The system module according to claim 4, wherein the predetermined distance is between 15 millimeters and 25 millimeters.

6. The system module according to claim 1, wherein the valve includes a seat fixed to the body and a pintle relatively displaceable with respect to the seat.

7. The system module according to claim 6, wherein the port is in fluid communication with the passageway at a location between the valve seat and the orifice.

8. The system module according to claim 6, further comprising:

a bearing interposed between the pintle and the body, the bearing facilitating relative sliding movement of the pintle with respect to the body; and a diaphragm having a first portion fixed to the pintle, a second portion fixed with respect to the body, and a flexible portion connecting the first and second portions.

9. The system module according to claim 8, wherein the body includes a cap and the diaphragm is clamped between the cap and an upper body.

10. The system module according to claim 9, wherein the diaphragm and the upper body define a chamber adapted to be in fluid communication with a supply of vacuum in the intake manifold.

11. The system module according to claim 10, further comprising:

an electric vacuum regulator valve regulating the supply of vacuum to the chamber.

12. The system module according to claim 11, further comprising:

a differential pressure sensor in fluid communication with the port on a first side of the orifice, and adapted to be in fluid communication with the supply of vacuum on a second side of the orifice.

13. The system module according to claim 12, wherein the electric vacuum regulator and the differential pressure sensor are integrally fixed to the upper body.

14. The system module according to claim 13, wherein the port includes a mouth spaced from the orifice between 15 millimeters and 25 millimeters along the axis, and is in fluid communication with the passageway at a location between the valve seat and the orifice.

15. An exhaust gas recirculation module comprising:

a valve assembly including a body having a passageway extending between an inlet and an outlet, and including a pintle controlling a flow of exhaust gases through the passageway, an orifice constricting the flow of exhaust gas through the body, and a port extending through the body and in fluid communication with the passageway between the inlet and the orifice, the orifice being aligned with the port along a common axis, the exhaust gases having a pressure;

a pressure sensor coupled to the valve assembly; and a pressure communication pathway providing fluid communication between the passageway and the pressure sensor, the pathway communicating the pressure of the exhaust gases at the port to the pressure sensor.

16. The exhaust gas recirculation module according to claim 15, where in the valve assembly further includes a fluid pressure actuator operatively coupled to the pintle.

17. The exhaust gas recirculation module according to claim 16, further comprising:

an electric vacuum regulator in fluid communication with the fluid pressure actuator.

18. The exhaust gas recirculation module according to claim 17, wherein the pressure sensor, the electric vacuum regulator, and the fluid pressure actuator are integrally fixed in a single unit.

19. A method of determining exhaust gas pressure, the exhaust gas being recirculated from an internal combustion engine to an intake manifold of the internal combustion engine, the method comprising:

providing a body including a passageway extending between an inlet and an outlet, the passageway communicating a flow of the exhaust gases;

providing an orifice constricting the flow of the exhaust gases proximate the outlet;

integrally mounting an exhaust gas pressure sensor on the body; and aligning a port along a common axis with the orifice, the port extending through the body and providing fluid communication from the passageway between the inlet and the orifice to the exhaust gas pressure sensor.

20. The method according to claim 19, further comprising:

spacing the port from the orifice between 15 millimeters and 25 millimeters along the common axis.

* * * * *